United States Patent [19]

Yuasa

[11] Patent Number: 4,867,705

[45] Date of Patent: Sep. 19, 1989

[54] ELECTRICAL CONNECTOR HOUSING HAVING HINGED TERMINAL-RETAINING MEANS

[75] Inventor: Katsuhiko Yuasa, Ageo, Japan

[73] Assignee: AMP Incorporated, Harrisburg, Pa.

[21] Appl. No.: 186,326

[22] Filed: Apr. 26, 1988

[30] Foreign Application Priority Data

Apr. 30, 1987 [JP] Japan ..... 62-66241

[51] Int. Cl.[4] ..... H01R 13/40

[52] U.S. Cl. ..... 439/595; 439/596

[58] Field of Search ..... 439/595, 596

[56] References Cited

U.S. PATENT DOCUMENTS

| | | | |
|---|---|---|---|
| 3,693,134 | 9/1972 | Trevisiol | 339/59 M |
| 3,727,174 | 4/1973 | Podmore et al. | 339/210 M |
| 3,842,388 | 10/1974 | Harwood et al. | 339/59 R |
| 4,200,350 | 4/1980 | Zimmerman, Jr. | 339/91 R |
| 4,679,874 | 7/1987 | Saijo et al. | 439/595 |
| 4,711,508 | 12/1987 | Sueyoshi | 439/595 |
| 4,753,612 | 6/1988 | Betsui | 439/595 |

FOREIGN PATENT DOCUMENTS

| | | |
|---|---|---|
| 1315693 | 5/1973 | United Kingdom . |
| 1525046 | 9/1978 | United Kingdom . |

*Primary Examiner*—P. Austin Bradley

*Attorney, Agent, or Firm*—Adrian J. LaRue; William B. Noll; Allan B. Osborne

[57] ABSTRACT

An electrical connector housing comprises a housing member (20) of dielectric material having passageways (22, 24) extending therethrough in which electrical terminals (50, 60) are disposed. Integral flap members (10, 10') are hingedly located adjacent a back end of the housing member (20) and they include projections, (11, 12') for engaging and maintaining the terminals (50, 60) in the respective passageways (22, 24) when the flap members (10, 10') are in their latched closed positions. Hook members (13) are located on the flap member (10) adjacent the projections (11) and they include hooks (14) that engage inner surfaces of the passageways (22) to prevent the flap member (10) from deflecting outwardly when forces are applied to the terminals (50) that are opposite to the direction of insertion of the terminals (50) in the passageways (22).

5 Claims, 7 Drawing Sheets

ELECTRICAL CONNECTOR HOUSING HAVING HINGED TERMINAL-RETAINING MEANS

FIELD OF THE INVENTION

The present invention relates to an electrical connector comprising a housing having passageways for removably receiving a plurality of electrical terminals therein, and a flap integrally hinged to the housing which maintains the terminals in position in their passageways.

BACKGROUND OF THE INVENTION

In general, an electrical connector comprises a housing having passageways for receiving a plurality of terminals therein, and a flap for reliably maintaining the terminals in the housing passageways. The housing comprises a plurality of resilient housing lances extending from an inner wall of the respective passageways to engage the terminals and to maintain them in their positions. The flap has projections projecting therefrom to engage the associated terminals and to push them along their axial directions for engagement by the housing lances thereby maintaining the terminals in the housing.

However, as the resilient housing lances are relatively long, it is difficult for the lances to resist a strong pulling force which may act on the terminals. On the other hand, the flap has a pair of latch projections at opposite ends of the flap so that these projections can engage the housing to latch the flap in a closed position on the housing while the projections engage the terminals. Thus, a disadvantage resulted in that, when the terminals are subjected to a strong pulling force, the force is transmitted to the flap via the projections so that the flap will bend or deflect whereby the latch projections may disengage from the housing.

SUMMARY OF THE INVENTION

An object of the present invention is to provide an electrical connector, in which hook members are provided on the flap to prevent it from bending or deflecting, even if the terminals are subjected to a strong pulling force thereon.

Another object of the present invention is to provide an electrical connector, in which different electrical terminals can be located in the same housing.

According to the present invention, an electrical connector comprises a dielectric housing having passageways for receiving a plurality of electrical terminals and being adapted to securely hold them in the housing, and a flap integrally hinged to the housing to move between an open position and a closed position, the flap having projections to engage the respective terminals thereby maintaining them in their passageways, the flap is provided with hook members adapted to latch the flap on the housing in the closed position thereby preventing the flap from bending or deflecting when the terminals are subjected to a strong pulling force thereon.

In the present invention the hook members can prevent the flap from bending or deflecting based on a strong pulling force that may act on the terminals, and, consequently, from being removed from the housing.

BRIEF DESCRIPTION OF THE DRAWINGS

The invention, together with objects and advantages thereof, is best understood by way of example with reference to the following detailed description in conjunction with the accompanying drawings.

FIG. 3 is a cross-sectional view along line 3—3 of FIG. 2.

DETAILED DESCRIPTION OF THE INVENTION

Figure 1:
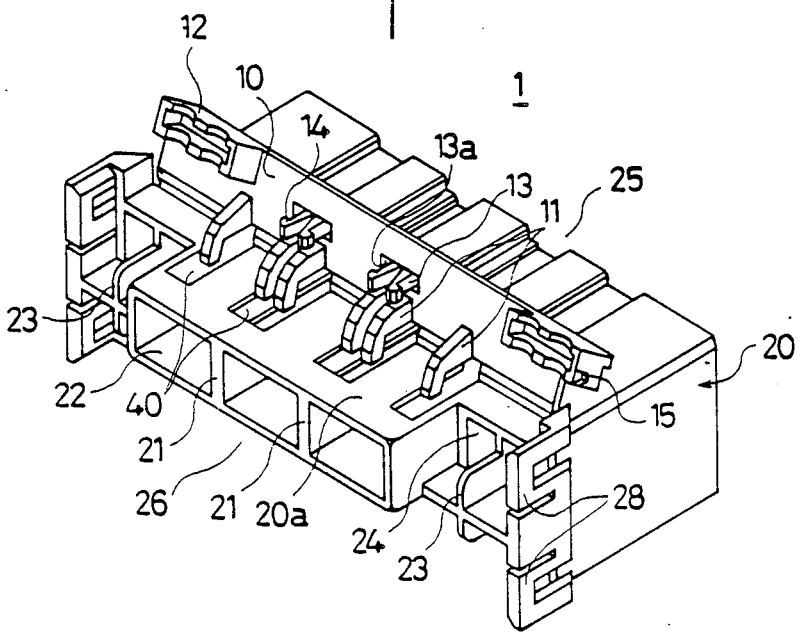
FIG. 1 is a perspective view of the connector housing looking from the rear.

An electrical connector 1 comprises a housing 20 having an integral flap 10. Housing 20 is molded from a suitable dielectric material. As can be seen from FIGS. 1 and 2, housing 20 is formed to receive two kinds of electrical terminals 50, 60, and has two rows of terminal receiving-passageways. One row has three terminal receiving-passageways 22, which are separated from each other by partitions 21. Terminal receiving-passageways 24 are located to each side of passageways 22 and in another row. Passageways 24 are separated from each other by partitions 23. Passageways 22, 24 are adapted to receive terminals 50, 60, respectively.

Figure 4:
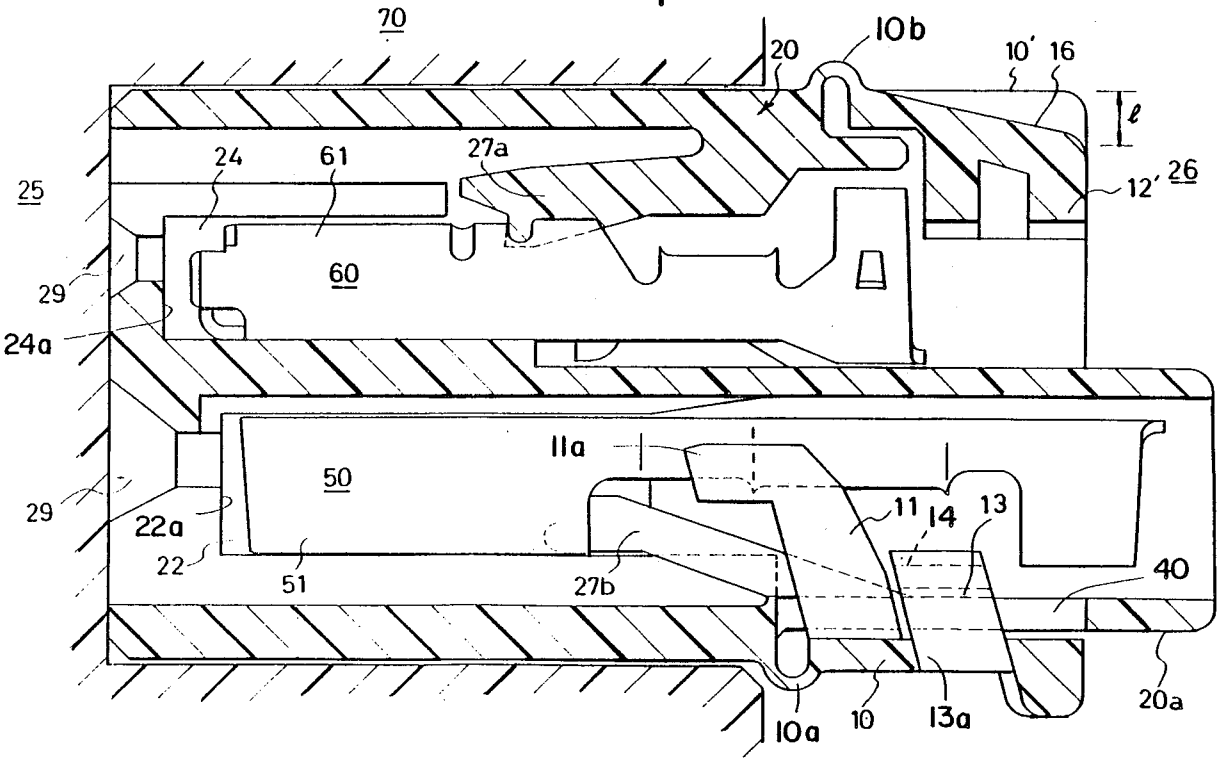
FIG. 4 is a cross-sectional along line 4—4 of FIG. 2.

Passageways 22, 24 are parallel to each other and open at both the forward ends 25 and the back ends 26, respectively. The openings of the forward ends 25 are in the form of slots 29 as shown in FIG. 4, which are to receive therethrough matable male contacts for electrical engagement with receptacle contact sections 51, 61 of terminals 50, 60, while the openings at the back ends 26 enable terminals 50, 60 to be inserted into passageways 22, 24. As shown in FIG. 4, integral resilient housing lances **27*a* and 27*b* extend forwardly from an upper wall of the passageways 24 and a lower wall of the passageways 22, respectively. These lances 27*b*, 27*a* are adapted to engage the terminals 50, 60, respectively, at the back ends of contact sections 51, 61 thereof, respectively, thereby urging terminals 50, 60 toward shoulders 22*a*, 24*a* at the front ends of passageways 22, 24 so as to removably maintain terminals 50, 60 in their respective passageways 22, 24**.

As shown in FIG. 4, flaps 10' and 10 are integrally hinged to the housing 20 at its upper and lower walls, respectively, adjacent to the back end 26. The upper flap 10' and the lower flap 10 are adapted to move clockwise and counterclockwise, respectively, so as to be in their respective closed positions, where they are aligned with the upper and lower surfaces, respectively, of the housing 20.

The flap 10 has a plurality of projections 11, which are associated with the passageways 22. Specifically, the projections 11 project from the flap 10 vertically thereof and in parallel to each other, and a pair of projections 11 are adapted to project into each passageway 22 adjacent to the inner side walls thereof. The housing 20 is provided with apertures 40 through which the projections 11 can pass. As clearly shown in FIG. 4, a hinge **10*a* integrally connecting the flap 10** to the housing 20, protrudes outwardly from the surface of the housing 20, even when the flap 10 is in the closed position. Therefore, the hinge 10*a* is located where the protrusion of the hinge does not hinder fitting the housing 20 into a cap housing 70. Thus, the flap 10 is located proximate to the rearward ends of the terminals 50 when positioned in passageways 22, and the free ends 11a of the pair of projections 11, which are upstanding from the flap 10, project toward the forward end of the housing to engage the back end of the contact portion 51 of the terminal 50. U.S. Pat. No. 3,693,134, which is assigned to the present assignee and the disclosure of which is incorporated herein by reference, explains in detail an electrical connector provided with a flap. However, the projection of the flap is different in shape from that of the present invention.

Figure 5:
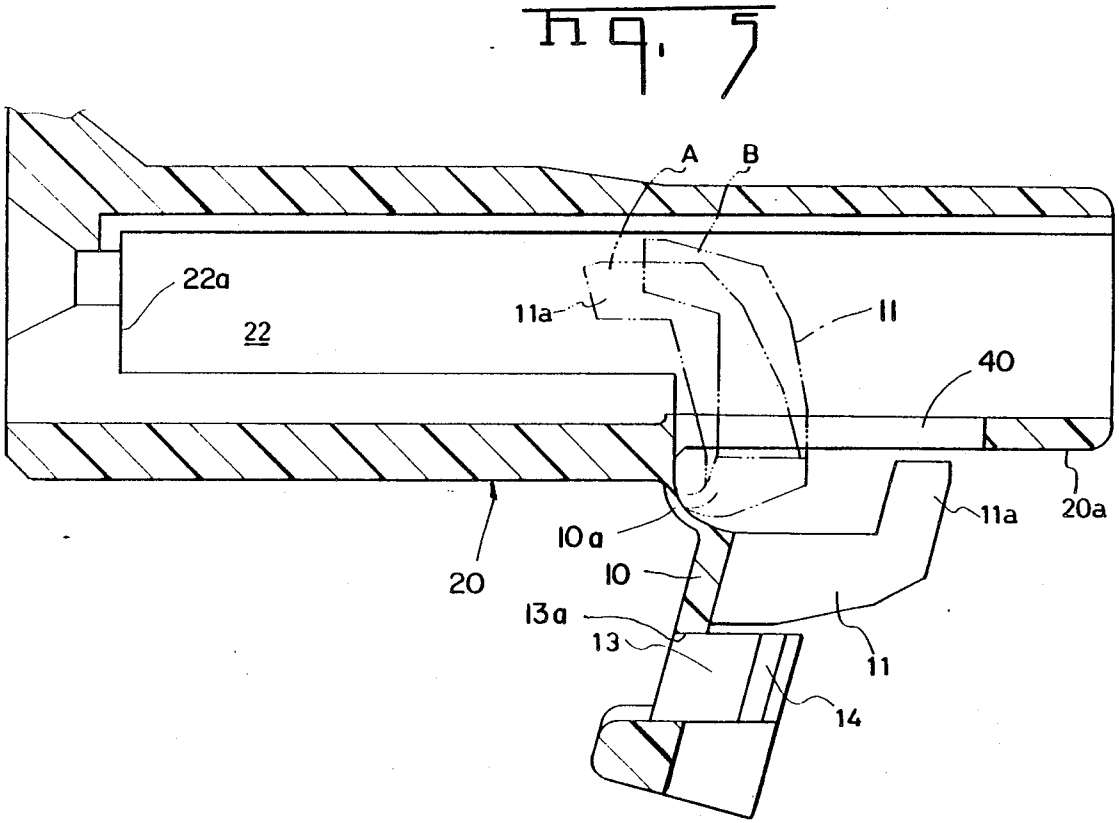
FIG. 5 is a cross-sectional view showing the operation of a flap projection.
Figure 6:
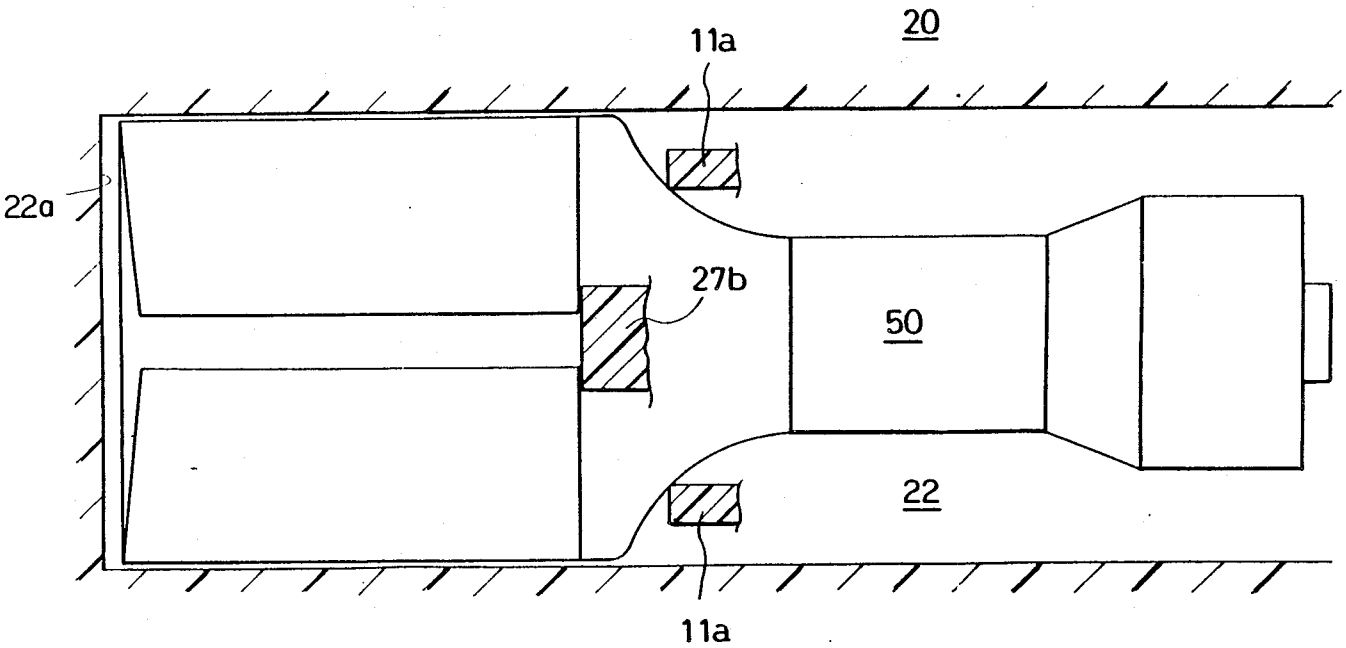
FIG. 6 is a plan view in cross section showing the manner of engagement of the housing lance and the flap projections of the housing with a terminal.
Figure 7:
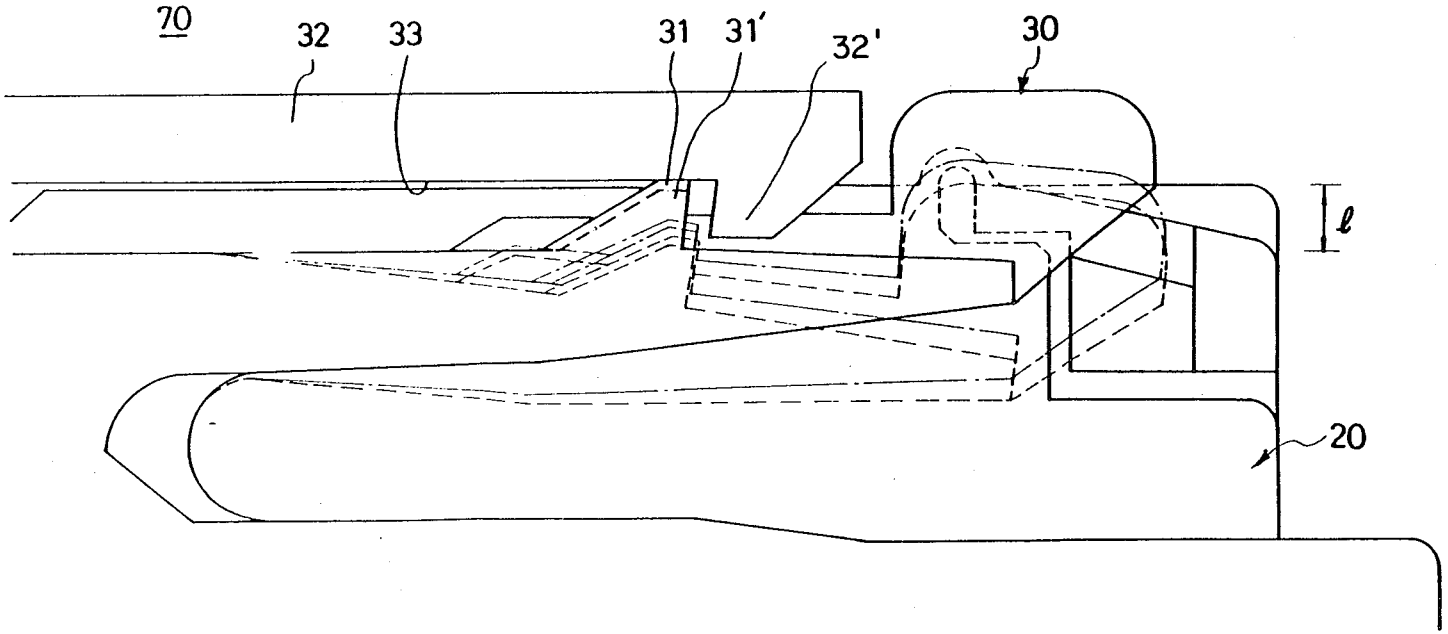

As discussed above, the housing 20 and the flap 10 is integrally molded, and molding dies can be removed in a lengthwise direction of the housing as will readily be understood from FIGS. 4 and 5. This means that the projected free ends 11*a* of the projections 11, as shown in FIG. 5, do not extend beyond the back ends of apertures 40 in a surface 20*a* of the housing 20. However, the free ends 11*a* are close to the surface 20*a* of the housing 20, while the flap 10 extends forwardly at an angle of about 105 degrees relative to the surface 20*a* of the housing 20. If the flap 10 were molded to have projections 11 extending vertically of the surface 20*a* of the housing 20, the projections 11 could move only up to a position B shown in FIG. 5. However, the flap 10 is actually molded to have an inclined position as abovementioned, and the projections 11 can move to a position A shown in FIG. 5, so that the ends 11*a* of the projections 11 can surely engage the contact section 51 of the terminal 50 and move it in an axial direction.

As shown in FIG. 1, the flap 10 has further projections 12 to engage the terminals 60. The projections 12 are for preventing terminals 60 from moving rearwards, and they have recesses shaped to conform to the configuration of the ferrules of the terminals 60.

Also, the flap 10 has hook members 13. Each hook member 13 extends from the flap 10 in the same plane and in the same direction as that of the projection 11 with which it is aligned. Each hook member 13 is provided at its free end with a hook 14 which extends outwardly at right angles relative to hook member 13. Opposed hooks 14 are adapted to pass through respective apertures 40 and are spaced apart from each other greater than the width of the aperture, so that in the closed position of the flap 10, the hooks 14 can engage the inner surface of passageways 22 at the side edges of the apertures 40. The flap 10 has holes 13*a* adjacent to the inner ends of hook members 13 through which hooks 14 are formed. The engagement of the hooks 14 with the inner surface of passageways 22 can be released by inserting a pin into the holes 13*a* and moving hooks 14 free of such surface.

The flap 10 is provided at its opposite sides with projections 15 (only one being shown in FIG. 1), which are adapted to engage the associated resilient latches 28 integral with the housing 20 at the opposite sides of the back end 26 of the housing. The latch 28 is in the form of a cantilever, is flexible, and therefore the projections 15 are releasably latched to the latches 28.

Figure 2:
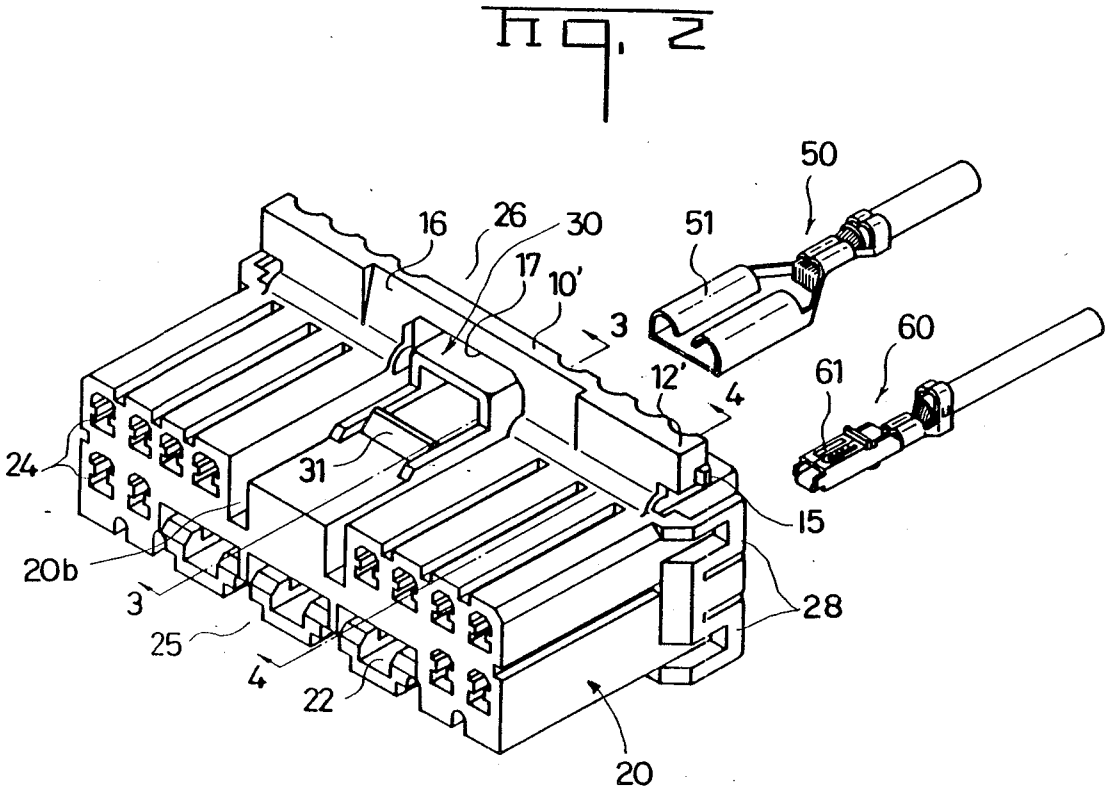
FIG. 2 is a perspective view of the housing shown in FIG. 1 looking from the front and two kinds of terminals exploded therefrom to be inserted in respective passageways of the housing.
Figure 7:
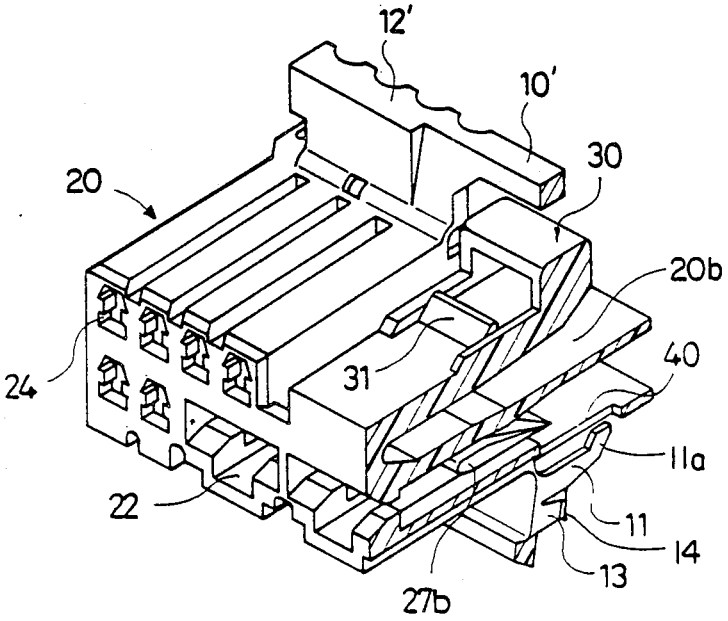
FIG. 7 is a view showing engagement relation between a latch arm and a projection of a latch member.

As shown in FIGS. 2, 3 and 7, the housing 20 is provided at the upper surface of the housing 20 with an integral latching lever 30, and a latching projection 31 is located on lever 30 toward the back end thereof. Lever 30 is integrally hinged at its front end to housing 20 and is disposed in recess 20b of housing 20 for reciprocal movement therein. The projection 31, as shown in FIG. 7, is engageable with a latching hook 32′ of an integral latch arm 32 of cap housing 70 to latch the housing 20 to the cap housing 70. The latch arm 32 is resiliently flexible so that latching hook 32′ is adapted to snap-fit on the projection 31. Specifically, as shown in FIG. 7, the projection 31 is higher than an ordinary one and is forcibly engaged with the latching hook 32′ of latch arm 32 with a click. Therefore, the engagement between the projection 31 and the latching hook 32′ of latch arm 32 can positively be recognized by such audible sound.

When releasing the housing 20 from the cap housing 70, the latching lever 30 is depressed to disengage the projection 31 from the latching hook 32′ of latch arm 32 while drawing the housing 20 away from the cap housing 70. In such a case, as the projection 31 is higher than the ordinary one 31′, the latching lever 30 must be depressed to the position shown in a broken line, which is lower than the position shown in a chain line (see FIG. 7). For this purpose, part of the upper surface 16 of the flap 10′ is inclined toward the back end of the housing 20 to have an inclined end, which is lower by the distance 1 in height than the upper surface of the housing 20, thereby enabling the locking lever 30 to be depressed to the lower position.

The flap 10′ has an aperture 17 enabling the latching lever 30 to pass through without the flap interfering with the movement of the lever. Also, the flap 10′ has projections 12′ associated with the passageways 24. The projections 12′ are generally similar in shape to that of the projections 12 on flap 10.

In assembling the terminals 50, 60 into the housing 20, these terminals are inserted in the respective passageways 22, 24, until the integral housing lances 27*b*, 27*a* engage the contact sections 51, 61 of the respective terminals 50, 60, and then the flaps 10 and 10′ are moved via their associated hinges 10a, 10b to position the projections 15 into engagement with the latches 28, while the projections 11 pass through the apertures 40 to engage the contact sections 51 of the terminals 50, so as push the terminals axially forwardly if necessary, and the projections 12 engage the ferrules of the terminals 60. Thus, both the housing lances 27*a*27*b* and the projections 11, 12 resist the backward movement of the terminals. At the same time, the hooks 14 of hook members 13 engage the inside surfaces of passageways 22 at side edges of the apertures 40 after they pass through these apertures to prevent flexing of flap 10. Thus, if terminals 50, 60 are not fully engaged by housing lances 27b, 27a, projections 11, 12 will push terminals 50, 60 forwardly in passageways 22, 24 when flaps 10, 10′ are closed to enable lances 27b, 27a to engage contact sections 51, 61 of terminals 50, 60.

According to the structure of the connector of this invention, even if the terminals are subjected to a pulling force the flap 10 is firmly maintained in position on the housing 20 by the hook members 13, the flap 20 is not therefore bent nor deflected. On the other hand, the engagement of the projections 15 with the latches 28 can surely be maintained. The terminals can be removed from the housing by inserting a pin in the holes 13a to deflect the hooks 14 so that the hooks 14 can be released from the housing 20 to enable the flap 10 to be opened.

As will be understood from the above, even if the terminals are subjected to strong force, the flap can be prevented from opening. Also, terminals having different kinds of shapes can be received and firmly held in the housing. Moreover, when the terminal has been inserted in the housing, it is possible to confirm that the inserting of the terminal has fully or correctly been carried out, based on the fact that the projections engage the terminal. If the housing lance does not correctly engage the terminal, the terminal can be pushed to the proper position in the passageway by the flap projections so that the housing lance does correctly engage the terminal when the flap is closed thereby resulting in a double latched condition of the terminal in the housing.

I claim:

1. An electrical connector housing, comprising:

a body member of dielectric material having passageway means extending therethrough from a front end to a back end for receiving therein electrical terminal means, said passageway means having a stop means adjacent said front end, said body member having a wall provided with aperture means in communication with said passageway means;

flap means hingedly connected to said body member and being movable from an open position to a closed position;

latch means provided by said body member and said flap means for maintaining said flap means in the closed position.

projection means on said flap means adapted to extend through said aperture means into said passageway means for maintaining the terminal means, when positioned in said passageway means and when said flap means is latched at said closed position, in position in said passageway means between said front stop means and said projection means; and laterally projecting additional latch means positioned on said flap means and located adjacent said projection means for insertion through said aperture means for engagement with said wall to prevent said flap means for deflecting outwardly when a force is applied to the terminal means.

2. An electrical connector housing as claimed in claim 1, wherein said additional latch means comprise hook members on the flap means having hooks for engagement with inner surface means of said wall.

3. An electrical connector housing as claim in claim 1, wherein said body member includes resilient housing lance means extending forwardly from inner surface means of said passageway means for engagement with the terminal means when positioned in said passageway means.

4. An electrical connector housing for receiving different kinds of electrical terminal means, comprising:

a body member of dielectric material having first passageway means in a first row for receiving therein first electrical terminal means and second passageway means in a second row parallel to the first row for receiving therein second electrical terminal means, said passageway means extending from a front end of said body member to a back end thereof and having stop means adjacent said front end, said body member having a wall provided with aperture means in communication with said first passageway means;

first and second flap means hingedly connected to said body member and being moveable from an open position to a closed position;

latch means provided by said body member and said flap means for maintaining said flap means in their closed positions;

projection means on said first and second flap means for maintaining the first and second terminal means, when respectively positioned in said first and second flap passageway means and when said first and second flap means are latched at said closed positions, in position in said first and second passageway means between said front stop means and said projection means, the projection means on said first flap means being insertable through said aperture means into said first passageway means; and laterally projecting additional latch means positioned on said flap means and located adjacent said projection means for insertion through said aperture means for engagement with said wall to prevent said first flap means from deflecting outwardly when a force is applied to the first terminal means.

5. An electrical connector housing as claimed in claim 4, wherein said body member includes resilient housing lance means extending forwardly from inner surface means of said passageway means for engagement with the terminal means when positioned in said passageway means.

* * * * *